US006981670B2

(12) United States Patent
Harrington

(10) Patent No.: US 6,981,670 B2
(45) Date of Patent: Jan. 3, 2006

(54) REEL HAVING APPARATUS FOR IMPROVED CONNECTION OF LINEAR MATERIAL

(75) Inventor: Jeffrey M. Harrington, Vancouver, WA (US)

(73) Assignee: Great Stuff, INC, Austin, TX (US)

( * ) Notice: Subject to any disclaimer, the term of this patent is extended or adjusted under 35 U.S.C. 154(b) by 0 days.

(21) Appl. No.: 10/414,508

(22) Filed: Apr. 15, 2003

(65) Prior Publication Data

US 2004/0206849 A1 Oct. 21, 2004

(51) Int. Cl.
*B65H 75/28* (2006.01)

(52) U.S. Cl. ..... 242/402; 242/407; 242/579; 242/586.1; 242/587.1; 242/125.1

(58) Field of Classification Search ..... 242/402, 242/407, 407.1, 586, 586.1, 586.2, 586.3, 242/586.4, 587, 587.1, 579, 125.1; 254/371, 254/372, 373, 374; 191/12.2 R, 12.2 A, 191/12.4; 137/355.26, 355.27
See application file for complete search history.

(56) References Cited

U.S. PATENT DOCUMENTS

| | | | | |
|---|---|---|---|---|
| 321,172 | A * | 6/1885 | Baldwin | 137/355.26 |
| 1,913,508 | A * | 6/1933 | Phillips | 242/587.1 |
| 2,053,976 | A | 9/1936 | Stahl | |
| 2,204,938 | A | 6/1940 | Le Bus | |
| 2,358,580 | A * | 9/1944 | Leonard | 242/586.1 |
| 2,584,099 | A * | 1/1952 | Harkrader | 242/125.1 |
| 2,631,063 | A * | 3/1953 | Jensen | 138/355.26 |
| 2,641,790 | A | 6/1953 | Coult | |
| 2,642,312 | A * | 6/1953 | Shine | 242/407 |
| 2,732,150 | A | 1/1956 | Le Bus, Sr. | |
| 2,795,385 | A | 6/1957 | Becker | |
| 2,892,598 | A * | 6/1959 | Dudley | 242/586.1 |
| 2,973,941 | A * | 3/1961 | Lunde | 242/586.1 |
| 3,885,751 | A | 5/1975 | Kelch et al. | |
| 4,034,932 | A | 7/1977 | Ferch | |
| 4,210,295 | A * | 7/1980 | Brusselle | 242/125.1 |
| 4,506,698 | A | 3/1985 | Garcia et al. | |
| 4,586,676 | A | 5/1986 | Johnston et al. | |
| 4,993,449 | A | 2/1991 | Stutzman et al. | |
| 5,109,882 | A | 5/1992 | Eley | |
| 5,186,410 | A | 2/1993 | Toews | |

(Continued)

FOREIGN PATENT DOCUMENTS

| | | |
|---|---|---|
| FR | 1.248.439 A | 11/1960 |

(Continued)

*Primary Examiner*—John M. Jillions
(74) *Attorney, Agent, or Firm*—Knobbe, Martens, Olson & Bear LLP

(57) ABSTRACT

A linear material reel design promotes the uniform spooling of a linear material around a reel drum, while also reducing stress acting on the end of the linear material that is connected to the drum. A connector ramp has a connector face generally perpendicular to the outer surface of the drum and is configured to orient the connecting section of a linear material substantially parallel to the outer surface of the drum. A guide groove promotes uniformity of spooling. A retraction limiting band maintains a length of the linear material wrapped around the drum. The retraction limiting band, guide groove, and connector ramp can be employed together or independently. Methods of spooling linear material with the use of such apparatus are also provided.

17 Claims, 7 Drawing Sheets

U.S. PATENT DOCUMENTS

| | | | | |
|---|---|---|---|---|
| 5,381,981 | A | 1/1995 | Nelson | |
| 5,462,298 | A | 10/1995 | Bodine | 242/403 |
| 5,598,985 | A * | 2/1997 | Winesett | 242/407 |
| 5,664,766 | A * | 9/1997 | Baziuk | 242/579 |
| 6,241,175 | B1 | 6/2001 | Nichols | 242/395 |
| 6,422,500 | B2 | 7/2002 | Mead, Jr. | 242/397.3 |
| 2002/0104918 | A1 * | 8/2002 | Zacharias | 242/587.1 |

FOREIGN PATENT DOCUMENTS

| | | | |
|---|---|---|---|
| FR | 1.285.919 | A | 1/1962 |
| GB | 384787 | | 12/1932 |
| GB | 656661 | | 8/1951 |
| GB | 902565 | | 8/1962 |
| JP | 08 107852 | A | 4/1996 |

* cited by examiner

REEL HAVING APPARATUS FOR IMPROVED CONNECTION OF LINEAR MATERIAL

BACKGROUND OF THE INVENTION

1. Field of the Invention

The invention relates to reels for spooling linear material and, in particular, to apparatus for connecting the linear material to the reel.

2. Description of the Related Art

The spooling of linear material has wide applicability in a number of fields. A linear material reel may be a small component of a large complex machine or may be used alone as an independent device. Linear materials that can be spooled also vary widely, and include steel cable, hose, electrical cord, and other materials.

In practice, linear material is typically connected to a reel drum such that an end portion or "connection portion" of the linear material is generally perpendicular to the outer surface of the drum. In order to be wrapped around the drum, the linear material begins to turn immediately from the connection point, causing a degree of "kinking" and/or twisting of the linear material. As a result, the linear material is subjected to stress at the region of kinking and/or twisting. In addition, the perpendicularly protruding connection portion of the linear material creates a protrusion or bump, which causes uneven layering of the linear material as it is spooled over the point of connection to the drum. The bump can cause a motorized reel assembly to experience damaging vibrations and jolts whenever the linear material is layered upon the bump created by the protruding perpendicular connector.

SUMMARY OF THE INVENTION

A linear material reel is provided offering improved connection of linear material to the reel drum. The present invention seeks to advance the art by providing one or more features that address the aforementioned problems.

In one aspect, the present invention provides a linear material reel comprising a reel drum upon which linear material can be spooled, the drum having a generally cylindrical outer surface. In addition, a connector ramp is located on the outer surface of the drum, the ramp having a connector face extending generally perpendicularly from the outer surface of the drum. The connector ramp is configured to position a connecting portion of the linear material generally parallel to the outer surface of the drum.

In another aspect, the invention provides a linear material reel comprising a reel drum, two spooling end plates, and a retraction limiting band. The reel drum has an outer surface upon which linear material can be spooled, the drum having two ends. Each of the spooling end plates is positioned on one of the ends of the drum. The retraction limiting band is configured to prevent a portion of an innermost layer of spooled linear material from completely unwinding from the reel drum. The band is configured to reside between the innermost layer of spooled linear material and a layer of spooled linear material positioned radially outward from the innermost layer.

In another aspect, the invention provides a linear material reel comprising a reel drum upon which linear material can be spooled, a connector ramp, and a retraction limiting band. The reel drum has a generally cylindrical outer surface, on which the connector ramp is located. The ramp has a connector face extending generally perpendicularly from the outer surface of the drum. The ramp also has a connector on the connector face, the connector being configured to be connected to an end of a linear material. The connector is configured to position a connecting portion of the linear material generally parallel to the outer surface of the drum. The retraction limiting band is configured to prevent a portion of an innermost layer of spooled linear material from completely unwinding from the reel drum. The band is also configured to reside between the innermost layer of spooled linear material and a layer of spooled linear material positioned radially outward from the innermost layer. The outer surface of the drum has a helical guide groove encircling the drum, the groove being configured to receive linear material. The groove extends generally from the connector face toward the center of the reel drum.

In yet another aspect, the invention provides a method of reeling a linear material onto a reel drum having a ramp located on an outer surface of the drum. The ramp includes a connector face oriented generally perpendicularly with respect to the outer surface of the drum. The ramp also includes a connector on the connector face. The ramp is configured so that when a connecting end of a linear material is connected to the connector, the connecting end is generally parallel to the outer surface of the drum. The method comprises attaching a linear material to the connector and rotating the reel drum to reel the linear material onto the drum.

In yet another aspect, the invention provides a method of unspooling linear material from a reel. A reel drum is rotated to unwind a linear material from the drum. A retraction limiting band is utilized to prevent only a portion of an innermost layer of the spooled linear material from completely unspooling from the drum. The band is positioned radially exterior of the outer surface of the drum and extends generally parallel to an axis of rotation of the drum. The band is secured to the outer surface of the drum.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of the above-noted aspects are intended to be within the scope of the invention herein disclosed. These and other aspects of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

As explained above, linear material reels, especially motorized reels, often subject the connecting portions of linear materials to potentially damaging stress. Also, there is a chance that the linear material will disconnect from the reel when the linear material is completely unwound from the reel drum. Preferred embodiments of the present invention seek to advance the art with regard to these problems.

Figure 1:
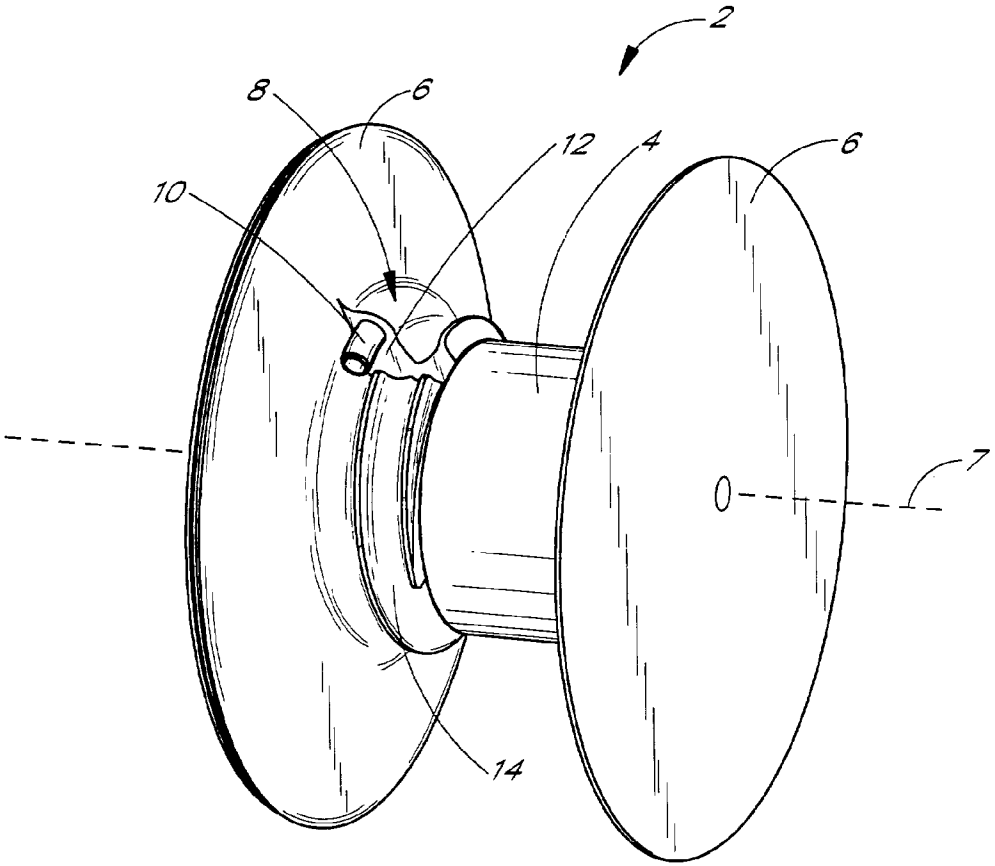
FIG. 1 is a perspective view of a hose reel according to one embodiment of the present invention, having a hose connector ramp and a guide groove.

Referring to FIG. 1, a reel 2 is shown having features that help to overcome the aforementioned problems. While the illustrated reel 2 is designed for the spooling of hose, those of skill in the art will understand that the reels disclosed herein can be modified to spool any of a variety of linear materials. The reel 2 has a reel drum 4 flanked by two spooling end plates 6. The reel 2 is preferably designed to rotate about an axis 7. A connector ramp 8 preferably is configured to orient a connector 10 so that when a linear material (not shown) is attached to the connector 10, the connecting portion of the linear material is oriented substantially parallel to the outer surface of the reel drum 4. In the illustrated embodiment, the connector 10 is a rigid cylindrical tube threaded to receive a complementarily threaded connecting end of a hose so that the hose and the connector 10 are fluidly coupled and fluidly sealed. However, the skilled artisan will appreciate that the connector 10 can have any of a variety of forms, depending upon the nature of the linear material. For example, if the linear material is electrical cord, the connector 10 can be configured to be similar to an electrical outlet. The connector ramp 8 is preferably located on the outer surface of the drum 4 and, more preferably, proximate one of the ends of the reel drum 4. Preferably, the connector ramp face 12 abuts the inner face of one of the spooling end plates 6. In the preferred embodiment, the drum 4 and ramp 8 are formed separately from the end plates 6, the plates and drum being secured together. Of course, the drum 4, ramp 8, and end plates 6 can be formed together as one piece, such as by molding or the like. Preferably, the connector ramp face 12 is generally perpendicular to both a spooling end plate 6 and the drum outer surface. The connector 10 preferably protrudes from the face 12 of the connector ramp 8.

Preferably, a helical guide groove 14 is located on the outer surface of the reel drum 4. More preferably, this guide groove 14 is integrated with the connector ramp 8 so that, when the linear material is attached to the connector 10, the linear material is aligned with the guide groove 14. Channeling the linear material into the guide groove 14 has the effect of initiating even and orderly wrapping of the linear material around the reel drum 4. Preferably, the guide groove 14 extends at least one wrap, more preferably at least 2 wraps, and more preferably within a range of 1–3 wraps around the reel drum 4. The groove 14 can extend across a portion of the drum 4 surface, or even across the entire drum surface. In a preferred embodiment, the groove 14 encircles the outer surface of the drum 4 at least once, but not more than five times. In another embodiment, the guide groove 14 is non-helical. For example, the drum 4 can include multiple side by side guide grooves oriented parallel to the end plates 6.

The hose connection ramp 8 is preferably also helical and thus gradually increases not only in height above the drum face (i.e., spiral shaped), but also in thickness away from the end plate as the ramp 8 curves toward the connector ramp face 12 (i.e., helical shaped). Accordingly, the connector ramp 8 also preferably serves to begin guiding the hose to start the proper winding pattern by gradually protruding from the flange or side wall of the spool out towards the center of the reel in a helical fashion, completing preferably 75 to 95 percent of a revolution. Desirably, the connection means do not at all intrude onto the drum face. However, since this is not possible without kinking the hose, the preferred embodiments minimize the impact of the connector ramp 8. By ghosting the first revolution of the reel in a helical fashion from the reel flange or end plate, the hose connection means simply transitions from the reel material (e.g., plastic, or metal) to the hose material without interrupting the natural helical form that occurs when winding linear material. It should be noted that the function of the helical groove 14 can thus be served by the helical connector ramp 8, such that the groove 14 can be omitted. It should also be noted that although the helical shaped connector ramp 8 is the preferred shape, a simple spiral ramp, either formed into the reel or added on as a separate piece, also serves to connect a hose to the reel in a fashion that is less likely to kink than traditional means; however, such a simple spiral ramp would not serve to guide the preferred helical winding pattern of the hose upon the drum.

By orienting the connection portion of the hose generally parallel to the drum 4 outer surface, the connector ramp 8 and the connector 10 advantageously prevent the connection section of the hose from protruding radially from the outer surface of the reel drum 4 to an extent significantly greater than the width of the linear material itself. This reduces the stress on the connecting portion of the hose in comparison to prior art reels, in which the hose typically extends radially from the drum and then bends sharply to begin wrapping around the drum. Thus, the connector ramp 8, with its spiral, gradually increasing radius, prevents the formation of the protrusion or "bump" associated with prior art reels, described above in the Background section. As explained above, the guide groove 14 facilitates more uniform spooling. In operation, the linear material is first connected to the connector 10 so that the linear material is substantially parallel to the outer surface of the reel drum 4. The reel drum is configured such that when the linear material is connected to the connector 10, the linear material is advantageously placed within a preferably helical guide groove 14. As the reel 2 is rotated about its axis 7, the first few wraps of the linear material are spiraled by the guide groove 14 in such a way as to provide a uniform and even starting pattern for the rest of the linear material to follow as it is spiraled across the outer surface of the reel drum 4. In the illustrated embodiment, the guide groove 14 extends across only a small portion of the outer surface of the drum 4. However, the skilled artisan will appreciate that the groove 14 can extend across a large portion or even the entirety of the outer surface of the drum 4.

Figure 2B:
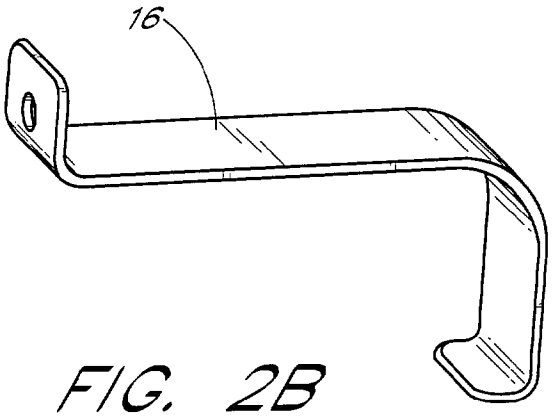
FIG. 2B is an enlarged view of the hose retraction limit band of FIG. 2A, which can also be employed in other embodiments.
Figure 2A:
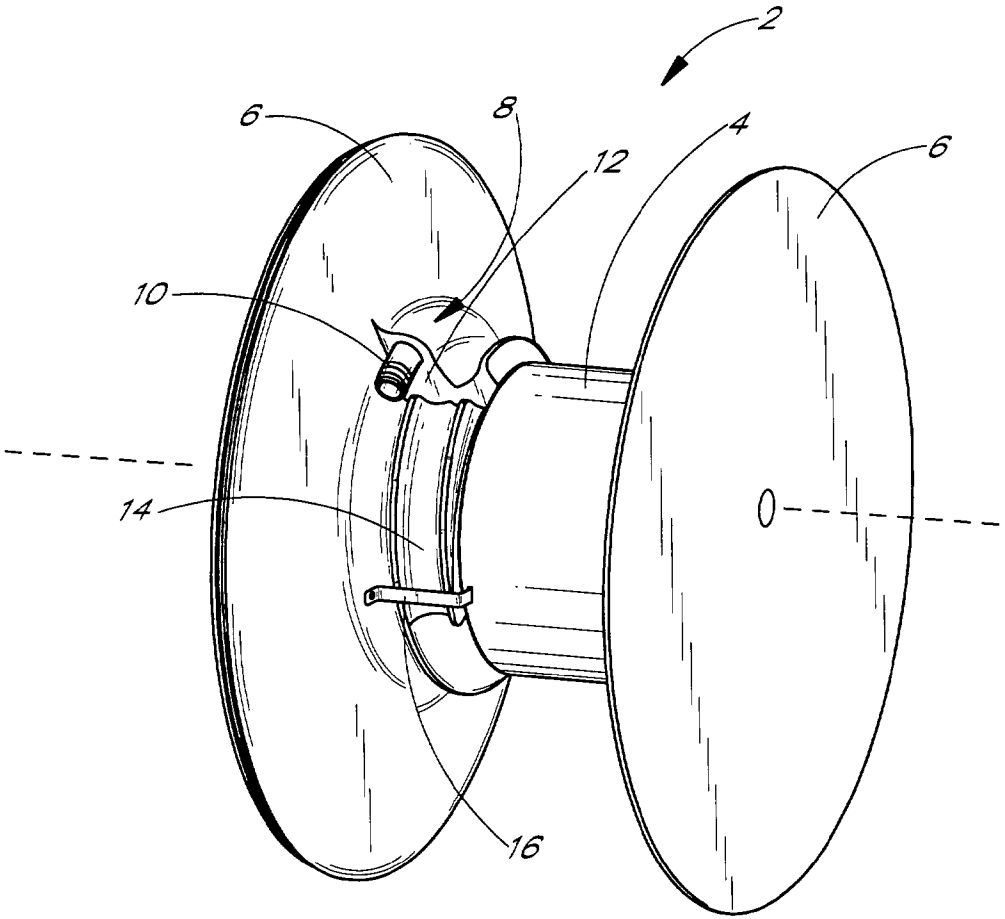
FIG. 2A is a perspective view of a reel according to another embodiment of the present invention, having a hose connector ramp, a guide groove, and a retraction limit band.

FIG. 2A shows a reel similar to that of FIG. 1, the difference being that the reel of FIG. 2A further includes a retraction limiting band 16 configured to span the width of at least one helical coil of the guide groove 14. Herein, each helical or non-helical encirclement of the groove 14 around the drum 4 is referred to as one of the "coils" of the groove 14. The retraction limiting band 16, shown more closely in FIG. 2B, is preferably configured to prevent a minimum number of wraps of the linear material located closest to the reel drum outer surface from fully unwinding from the reel drum 4. As used herein, a "wrap" of linear material refers to one helically wound segment of the linear material wrapped around the reel drum, beginning and ending at the same angular position on the reel drum outer surface, so that the wrap has a length approximately equal to the circumference of the outer layer of wrapped material. As a result of maintaining a minimum number of warps of an innermost linear material layer against the real drum surface, potentially damaging stress on both the connecting section of linear material and the connector 10 itself is reduced. The band 16 also reduces the likelihood of the linear material disconnecting from the connector 10 when the linear material is completely unspooled. At complete unspooling, the band effectively transfers tension stress from the connector 10 to the portion of the linear material under the band 16. The retraction band 16 is preferably configured to prevent 0.1–3 wraps, more preferably 0.5–3 wraps, and even more preferably at least 1.25 wraps of the linear material from unspooling from the reel drum 4. At about 1.25 wraps, the band ensures a full wrap of the hose on other linear material stays on the drum, with minimal lost use of hose length.

Preferably, the retraction limiting band 16 is attached at one end to one of the spooling end plates 6, while the other end attaches to the outer surface of the reel drum 4. In an alternate embodiment, the retraction limiting band 16 is attached to a lip of one of the coils of the guide groove 14, such as the one located furthest from the connector ramp 8. The retraction limiting band 16 may be selectively opened and closed via an opening mechanism such as a hinge (in the case of a rigid band 16), or a snap-on or button/button hole attachment (in the case of a flexible band 16). Such a mechanism facilitates both attachment and detachment of the linear material from the ramp connector 10 without having to feed or withdraw the linear material from underneath the retraction limiting band. The retraction limiting band 16 can be formed a rigid material, such as metal. Preferably, however, the band 16 is formed of more flexible materials, such as nylon to minimize stress and risk of the retraction limiting band 16 from biting into the hose and cutting it as the hose is "completely" unwound to the limit established by the band 16.

In operation, an initial length of the linear material is wrapped around the drum 4 within the guide groove 14 and positioned between the limiting band 16 and the outer surface of the drum 4. For example, if the retraction limiting band 16 is fixed and spans two coils of the guide groove 14, as shown in FIG. 2A, then a connecting end (not shown) of the linear material is preferably fed underneath the retraction limiting band 16 within each coil of the guide groove 14, starting with the coil of the groove 14 located furthest away from the connector ramp 8. The connecting end of the linear material is then channeled in the guide groove 14 and wrapped around the drum 4 so that the linear material is again fed underneath the band 16 within the groove 14 directly in line with the connector 10. Next, the linear material connector is joined with the connector 10 on the face 12 of the ramp 8. The operation of the reel 2 then continues in a similar fashion to the operation of the reel 2 shown in FIG. 1, except that when the linear material is completely unspooled the retraction limiting band 16 prevents an initial length of the linear material (about 1.25 wraps in the illustrated embodiment) from unwrapping from the reel drum (FIG. 2A). In alternate arrangements, employing an openable retraction limiting band 16, as described above, the band can be first opened to facilitate laying the linear material into the coils of the guide groove 14 and connecting the linear material to the connector 10. Once the linear material is positioned within the coils of the groove 14 and connected to the connector 10, the band 16 can be closed.

Although the preferred embodiment shown in FIG. 2A employs the connector ramp 8, guide groove 14, and retraction limiting band 16, it should be understood that alternate embodiments employ different combinations of these three particular aspects, such as only the retraction band and the connector ramp. Alternate embodiments employ the guide groove in combination with the retraction limiting band without a connector ramp. Other embodiments employ only a connector ramp. Some embodiments make use of only the retraction limiting band.

Figure 3A:
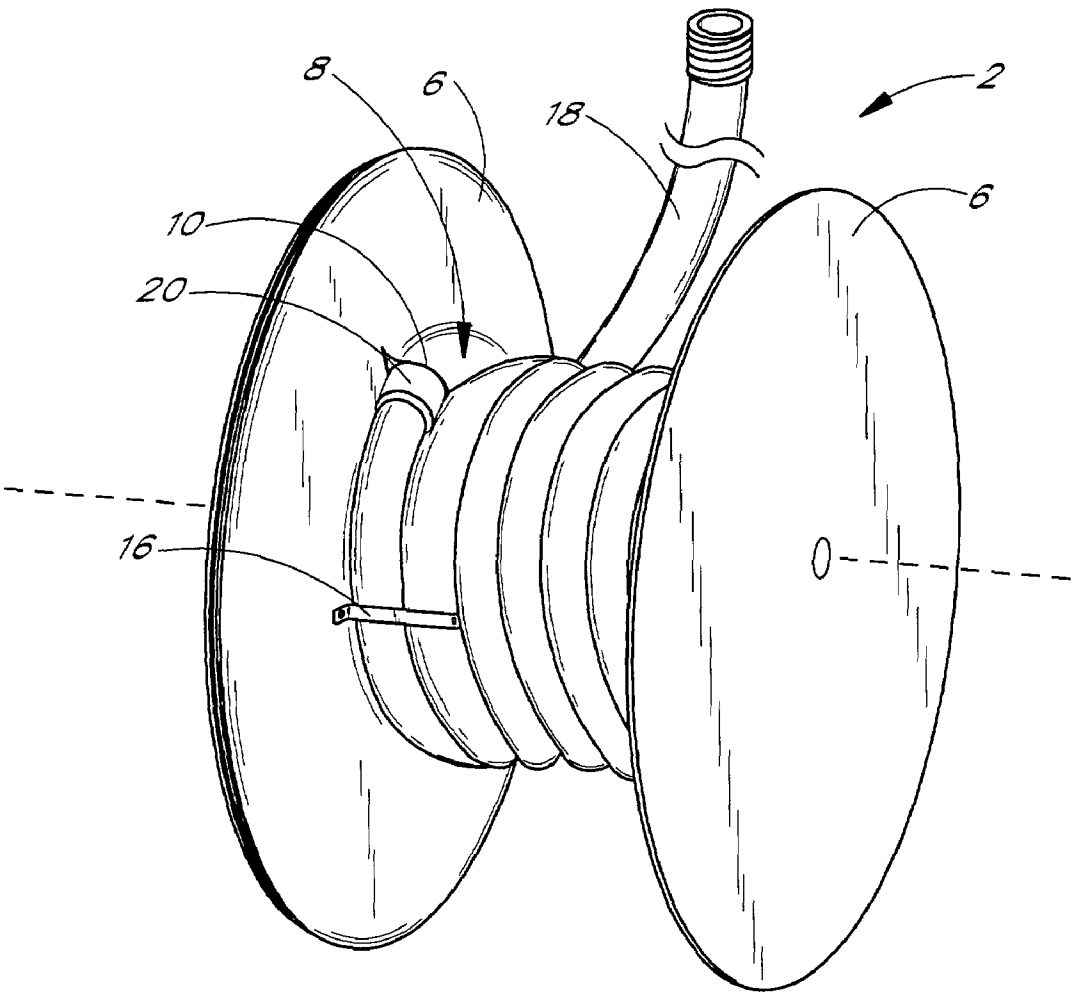
FIG. 3A is a perspective view of the hose reel of FIG. 2A, with a hose spooled thereupon.

With reference to FIG. 3A, the reel of FIG. 2A is shown with a linear material 18, here a garden hose, spooled onto the reel drum. The proximal end 20 of the garden hose is preferably threaded or otherwise fitted onto the connector 10, here a garden hose connector, extending from the connector ramp 8. The retraction limit band 16 preferably extends over the first 1.25 wraps of the hose.

Figure 3B:
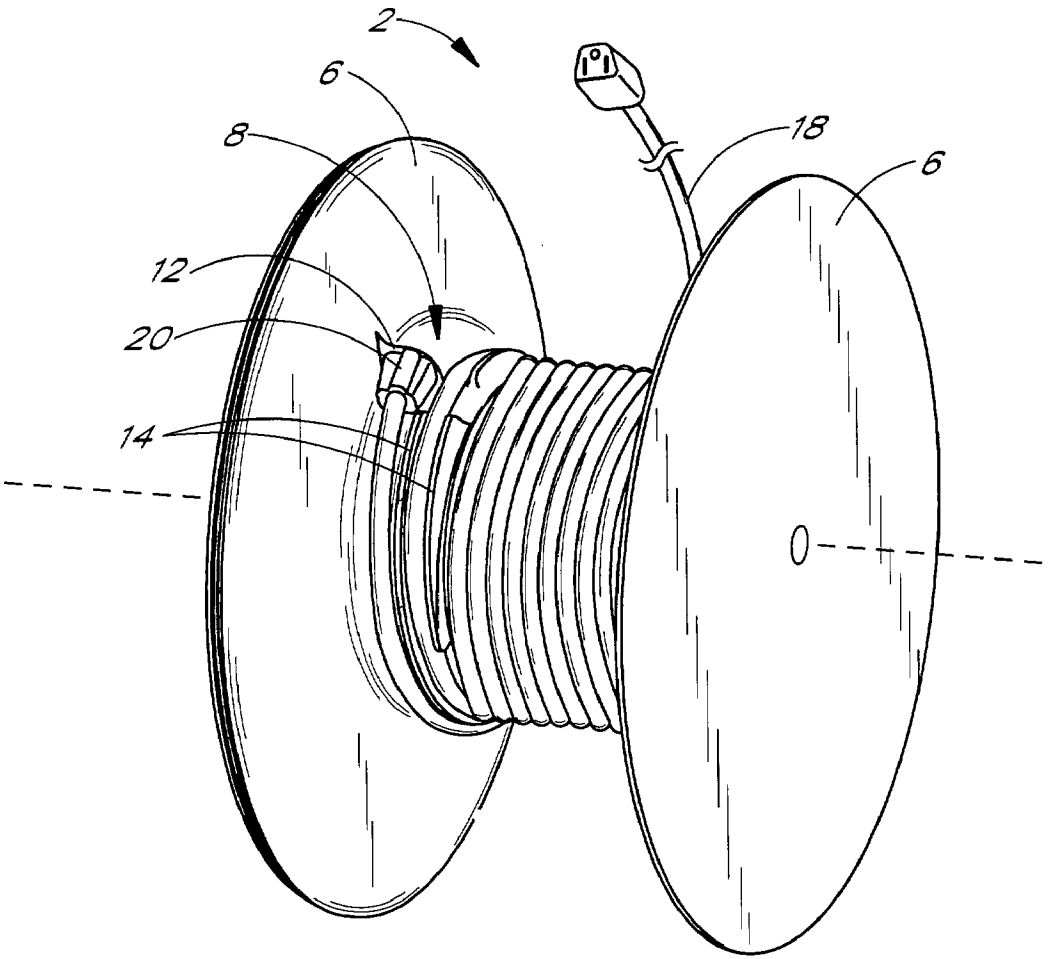
FIG. 3B is a perspective view of a cord reel, having a cord connector ramp and a guide grooves, constructed in accordance with another embodiment.

FIG. 3B shows the linear material reel 2 of FIG. 1 with a different linear material 18, here an electrical cord, spooled thereon. Preferably, the male proximal end 20 of the electrical cord is plugged into an outlet located on the connector ramp face 12, which is generally perpendicular to the outer cylindrical surface of the drum 4 (FIG. 2A). In addition, the width of each coil of the guide groove 14 is preferably adjusted for the width of the linear material 18. For example, the coil width of the guide groove 14 employed in FIG. 3B for an electrical cord is preferably narrower than the coil width of the guide groove 14 employed for a garden hose (FIG. 3A). In addition, a retraction limiting band (not shown), as described above with respect to the garden hose embodiment, is preferably employed in order to prevent an initial length of electrical cord from completely unspooling from the reel drum. Alternative means of preventing tension stress to the connection upon "complete" cord retraction include the use "zip" ties or the like.

Figure 4:
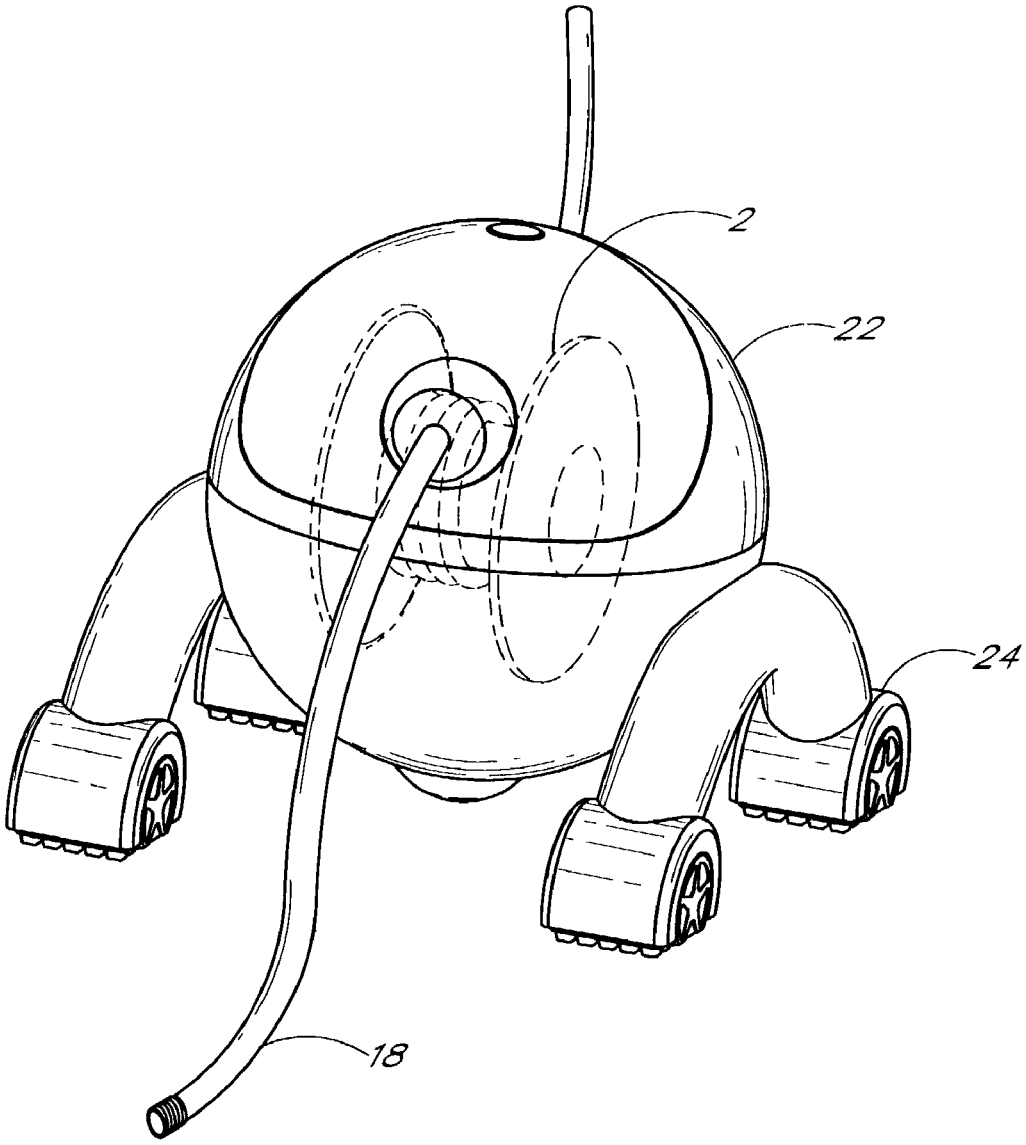
FIG. 4 is a perspective view of a hose reel according to a preferred embodiment of the present invention, having a wheeled, spherical housing.

FIG. 4 shows a preferred embodiment of the present invention having a linear material reel 2 located in a housing 22, which is illustrated with a spherical shape. Such a housing is shown and described in U.S. Pat. No. 6,279,848 B1, the entire disclosure of which is hereby incorporated herein by reference. Preferably, the reel 2 contained within the housing 22 is either motorized or, in alternate embodiments, is manually operated. In addition, the spherical housing 22 can be made mobile, such as by the provision of wheels 24. In a preferred embodiment, the reel 2 of the invention is provided with a reciprocating mechanism to reciprocate a hose aperture for uniformly spooling the linear material across the drum, such as that disclosed in U.S. Pat. No. 6,279,848 B1.

Although the linear materials illustrated in preferred embodiments are electrical cords and garden hoses, it should be understood that the present invention has utility as to a variety of linear materials, including, but not limited to, air hoses, straps, cables, rope, wires and other linear materials.

Figure 5:
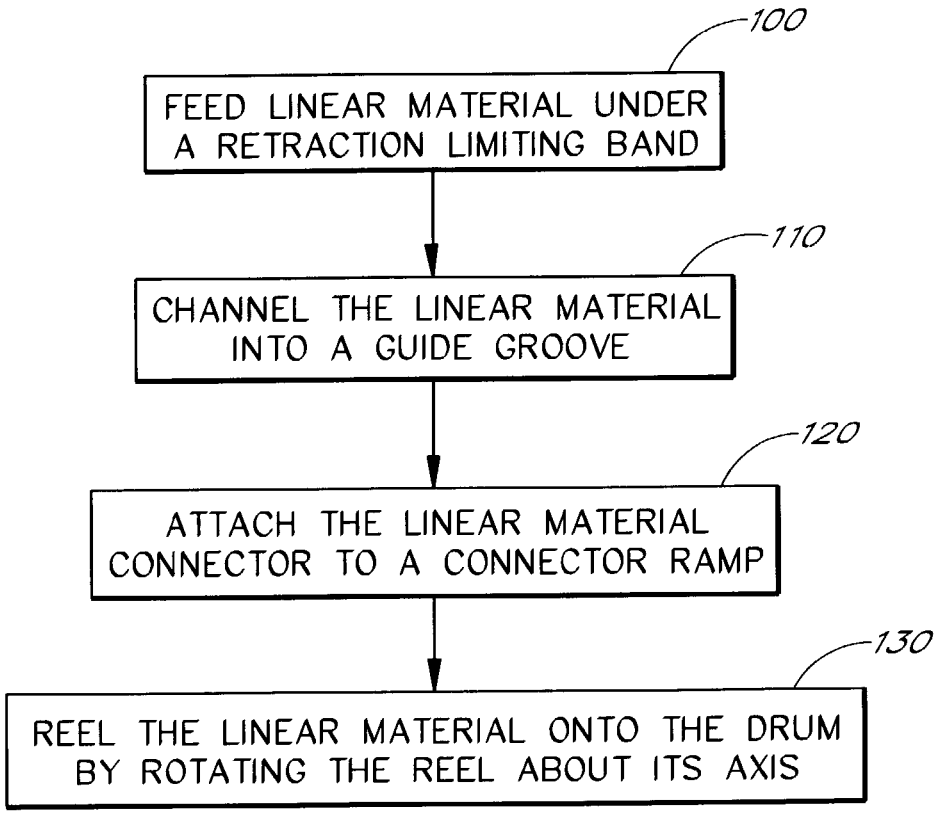
FIG. 5 is a flowchart describing a method of spooling a linear material onto a reel drum according to one embodiment of the present invention, the drum having a retraction limiting band, a guide groove, and a connector ramp.

FIG. 5 illustrates a method of reeling a linear material utilizing a retraction limiting band, a guide groove, and a connector ramp. The linear material is first fed 100 under a retraction limiting band at least once. Next, the linear material is channeled 110 into a guide groove. The linear material connector is then attached 120 to a connector ramp. Thereafter, the linear material is reeled 130 onto the drum by rotating the reel about its axis. In alternate embodiments, the method shown in FIG. 5 is practiced without the use of a retraction limiting band. In yet other embodiments, the method of FIG. 5 is practiced without the use of a guide groove. In yet another embodiment, the connector ramp is used but the guide groove and the retraction limiting band are both omitted from the design. In another embodiment, the retraction limiting band is used but the guide groove and the connector ramp are both omitted from the design.

Figure 6:
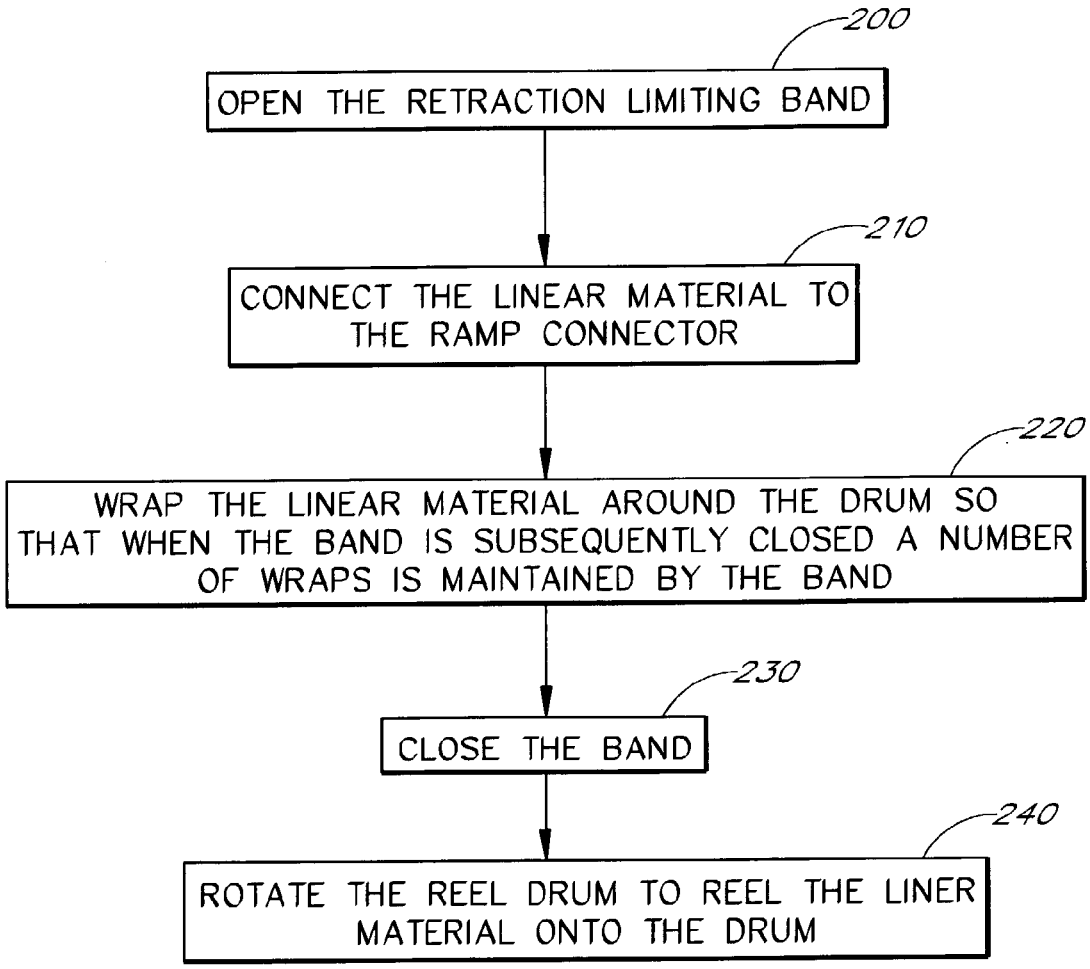
FIG. 6 is a flowchart describing a method of spooling a linear material onto a reel drum according to another embodiment of the present invention, the drum having a retraction limiting band that can be opened and closed.

FIG. 6 illustrates a method of reeling a linear material, similar to the method illustrated in FIG. 5. The difference is that the method of FIG. 6 utilizes a retraction limiting band that can be opened and closed, as described above. In the method of FIG. 6, a retraction limiting band is first opened 200 and the linear material is connected 210 to the ramp connector. The linear material is then wrapped 220 around the drum so that when the band is subsequently closed, the band maintains a desired number of wraps of the linear material on the drum. Next, the band is closed 230 and the reel drum is rotated 240 to reel the linear material onto the drum. In some embodiments, the linear material is channeled into a guide groove when wrapping the linear material around the drum.

Advantageously, the preferred embodiments facilitate uniform spooling of linear material using a reel system that is not overly expensive or complex. An additional advantage of the preferred embodiments is reduction of stress on both the connecting section of a linear material and the connector itself.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications thereof. Thus, it is intended that the scope of the present invention herein disclosed should not be limited by the particular disclosed embodiments described above, but should be determined only by a fair reading of the claims that follow.

I claim:

1. A linear material reel comprising:

a reel drum having an outer surface upon which linear material can be spooled, the drum having two ends;

two spooling end plates, each being positioned on one of the ends of the drum; and a retraction limiting band configured to prevent a portion of an innermost layer of spooled linear material from completely unwinding from the reel drum, the band configured to reside between said innermost layer of spooled linear material and a layer of spooled linear material positioned radially outward from said innermost layer, wherein the band is attached at one end to one of the two spooling end plates.

2. The reel of claim 1, further comprising a helical guide groove on the outer surface of the reel drum, the guide groove encircling the drum, the guide groove beginning adjacent one of the spooling end plates and extending across at least a portion of the drum outer surface.

3. The reel of claim 2, wherein the guide groove extends only partially across the reel drum outer surface.

4. The reel of claim 1, wherein the linear material is electrical cord.

5. The reel of claim 1, wherein the reel drum is enclosed in a generally spherical housing.

6. The reel of claim 1, wherein the band is positioned to maintain between 0.5 to 3 wraps of the linear material wrapped around the outer surface of the drum.

7. The reel of claim 1, wherein the band is positioned to maintain at least 1.25 wraps of the linear material wrapped around the outer surface of the drum.

8. The reel of claim 7, wherein the band is positioned to maintain about 1.25 wraps of the linear material wrapped around the outer surface of the drum.

9. A linear material reel comprising a reel drum having an outer surface upon which linear material can be spooled, the drum having two ends;

two spooling end plates, each being positioned on one of the ends of the drum;

a retraction limiting band configured to prevent a portion of an innermost layer of spooled linear material from completely unwinding from the reel drum, the band configured to reside between said innermost layer of spooled linear material and a layer of spooled linear material positioned radially outward from said innermost layer, and;

a connector ramp located on the outer surface of the drum, the ramp having a connector face extending generally perpendicular from the outer surface of the drum and configured to extend a connecting portion of the linear material from the connector face in a direction generally parallel to the reel drum outer surface.

10. The reel of claim 9, wherein the linear material is hose and the connector face of the connector ramp has a connector configured to be coupled with fluid communication to an end of the hose.

11. A linear material reel comprising:

a reel drum upon which linear material can be spooled, the drum having a generally cylindrical outer surface;

a connector ramp located on the outer surface of the drum, the ramp having a connector face extending generally perpendicularly from the outer surface of the drum, the ramp having a connector on the connector face, the connector configured to be connected to an end of a linear material, the connector configured to extend a connecting portion of the linear material from the connector face in a direction generally parallel to the outer surface of the drum; and a retraction limiting band positioned on the reel drum to prevent a portion of an innermost layer of spooled linear material from completely unwinding from the reel drum, the band configured to reside between said innermost layer of spooled linear material and a layer of spooled linear material positioned radially outward from said innermost layer.

12. The reel of claim 11, wherein the outer surface of the drum has a helical guide groove encircling the drum, the groove configured to receive linear material, the groove extending generally from the connector face around the reel drum outer surface and toward the center of the reel drum.

13. The reel of claim 12, wherein the groove comprises a partially cylindrical depression in the reel drum outer surface.

14. The reel of claim 12, wherein the groove extends within 1 and 5 wraps around the reel drum.

15. A method of reeling a linear material onto a reel drum, the reel drum having a ramp located on an outer surface of the drum, the ramp including a connector face oriented generally perpendicularly with respect to the outer surface of the drum, the ramp including a connector on the connector face, the ramp configured so that when a connecting end of a linear material is connected to the connector the connecting end is generally parallel to the outer surface of the drum, the method comprising:

attaching a linear material to the connector;

rotating the reel drum to reel the linear material onto the drum; and feeding the connecting end of the linear material under a retraction limiting band configured to prevent a portion of an innermost layer of spooled linear material from completely unwinding from the reel drum, the band configured to reside between said innermost layer of spooled linear material and a layer of spooled linear material positioned radially outward from said innermost layer.

16. A method of unspooling linear material from a reel, comprising:

rotating a reel drum to unwind a linear material from the drum; and utilizing a retraction limiting band to prevent only a portion of an innermost layer of the spooled linear material from completely unspooling from the drum, the band being attached at one end to a spooling end plate positioned at an end of the reel drum, wherein the band is positioned radially exterior of the outer surface of the drum and extending generally parallel to an axis of rotation of the drum, the band being secured to the outer surface of the drum.

17. The method of claim 16, wherein utilizing the band comprises preventing between 0.5 to 3 wraps of linear material from completely unspooling from the drum.

* * * * *